US009458818B2

(12) United States Patent
Luvaas

(10) Patent No.: US 9,458,818 B2
(45) Date of Patent: Oct. 4, 2016

(54) HYDRAULIC SYSTEM FOR MACHINE

(71) Applicant: Caterpillar Global Mining LLC, Oak Creek, WI (US)

(72) Inventor: John K. Luvaas, Mequon, WI (US)

(73) Assignee: Caterpillar Global Mining LLC, South Milwaukee, WI (US)

( * ) Notice: Subject to any disclaimer, the term of this patent is extended or adjusted under 35 U.S.C. 154(b) by 139 days.

(21) Appl. No.: 14/337,373

(22) Filed: Jul. 22, 2014

(65) Prior Publication Data

US 2016/0025097 A1 Jan. 28, 2016

(51) Int. Cl.
*F03B 1/00* (2006.01)

(52) U.S. Cl.
CPC ..... *F03B 1/00* (2013.01)

(58) Field of Classification Search
CPC ..... F04D 25/04; F03B 1/00
USPC ..... 137/115.11, 205.5, 206, 502
See application file for complete search history.

(56) References Cited

U.S. PATENT DOCUMENTS 2,509,130 A * 5/1950 Burks ..... F04D 13/16 137/211
2,705,457 A * 4/1955 Le Van ..... G05D 9/02 137/211
3,293,890 A 12/1966 Valdespino et al.
3,710,549 A 1/1973 Nichols et al.
4,475,522 A * 10/1984 Oonaka ..... F02M 25/0836 123/519
8,261,764 B2 * 9/2012 Miller ..... F04F 5/04 137/205.5

* cited by examiner

*Primary Examiner* — Kevin Murphy
*Assistant Examiner* — Daphne M Barry

(57) ABSTRACT

A hydraulic system for a machine is disclosed. The hydraulic system includes a hydraulic tank configured to store a liquid therein. The hydraulic system also includes a first conduit, a venturi, a fluid conduit and a second conduit. The first conduit is in fluid communication with the hydraulic tank and configured to receive the liquid from the hydraulic tank. The venturi is in fluid communication with the first conduit and configured to reduce a pressure of the liquid flowing therethrough. The fluid conduit is in fluid communication with the venturi and configured to supply a gaseous fluid into the venturi. The second conduit is in fluid communication with the venturi and configured to supply a mixture of the liquid and the gaseous fluid into the hydraulic tank in order to increase a pressure of the liquid in the hydraulic tank.

17 Claims, 6 Drawing Sheets

HYDRAULIC SYSTEM FOR MACHINE

TECHNICAL FIELD

The present disclosure relates to a hydraulic system for a machine, and more particularly to a hydraulic system and a method of controlling the hydraulic system for a machine.

BACKGROUND

Machines such as those used for, construction, agriculture, transportation and mining, include various hydraulic actuators associated with one or more systems of the machines, for example, an implement system, a steering system, a brake system and the like. The hydraulic actuators may include hydraulic cylinders, hydraulic motors, and the like. One or more pumps supply the hydraulic actuators with pressurized hydraulic fluid for actuation. The pumps are connected to a hydraulic tank which stores the hydraulic fluid. The hydraulic fluid may be maintained at an elevated pressure within the hydraulic tank in order to meet the inlet fluid characteristic requirements of the pumps. Typically, a compressor is connected to the hydraulic tank to provide pressurized air to the hydraulic tank and pressurize the hydraulic fluid therein. The compressor may require maintenance and become unreliable after a long period of operation. Further, in cold weather conditions, there may be a tendency of condensed water to freeze within the compressor.

U.S. Pat. No. 3,710,549 discloses a system for maintaining the oxygen content in the fuel vapor space of an aircraft fuel tank at less than 10 percent by volume. The system includes an aspirating type mixing nozzle that draws an inert gaseous mixture from the tank vapor space and mixes the inert gaseous mixture with liquid fuel being supplied to the tank. Thereby, the inert gaseous mixture scrubs dissolved oxygen from the fuel and returns to the vapor space with the scrubbed oxygen therein. The tank includes a vent means for venting excess gasses from the vapor space to the tank exterior as the tank fills with fuel and also includes means for further scrubbing of oxygen from the fuel during climb of the aircraft and for pressurizing the tank with inert gas during descent while excluding air from the tank.

SUMMARY OF THE DISCLOSURE

In one aspect of the present disclosure, a hydraulic system for a machine is disclosed. The hydraulic system includes a hydraulic tank configured to store a liquid therein. The hydraulic system also includes a first conduit in fluid communication with the hydraulic tank. The first conduit is configured to receive the liquid from the hydraulic tank. The hydraulic system further includes a venturi in fluid communication with the first conduit. The venturi is configured to reduce pressure of the liquid flowing there through. The hydraulic system includes a fluid conduit in fluid communication with the venturi. The fluid conduit is configured to receive a gaseous fluid into the venturi. A second conduit is in fluid communication with the venturi and configured to supply a mixture of the liquid and the gaseous fluid into the hydraulic tank in order to increase a pressure of the liquid in the hydraulic tank.

In another aspect of the present disclosure, a machine is disclosed. The machine includes a frame and a hydraulic tank mounted on the frame. The hydraulic tank is configured to store a liquid therein. A hydraulic system is in fluid communication with the hydraulic tank. The hydraulic system includes a first conduit in fluid communication with the hydraulic tank. The first conduit is configured to receive the liquid from the hydraulic tank. The hydraulic system also includes a venturi in fluid communication with the first conduit. The venturi is configured to reduce a pressure of the liquid flowing therethrough. The hydraulic system further includes a fluid conduit in fluid communication with the venturi. The fluid conduit is configured to supply a gaseous fluid into the venturi. The hydraulic system includes a second conduit in fluid communication with the venturi. The second conduit is configured to supply a mixture of the liquid and the gaseous fluid into the hydraulic tank in order to increase a pressure of the liquid in the hydraulic tank.

In yet another aspect of the present disclosure, a method of controlling a hydraulic system is disclosed. The method includes receiving a liquid from a hydraulic tank within a first conduit. The method also includes reducing a pressure of the liquid flowing through the first conduit by a venturi. The method further includes supplying a gaseous fluid into the venturi via a fluid conduit. The method includes supplying a mixture of the liquid and the gaseous fluid into the hydraulic tank in order to increase a pressure of the liquid in the hydraulic tank.

Other features and aspects of this disclosure will be apparent from the following description and the accompanying drawings.

DETAILED DESCRIPTION

Figure 1:
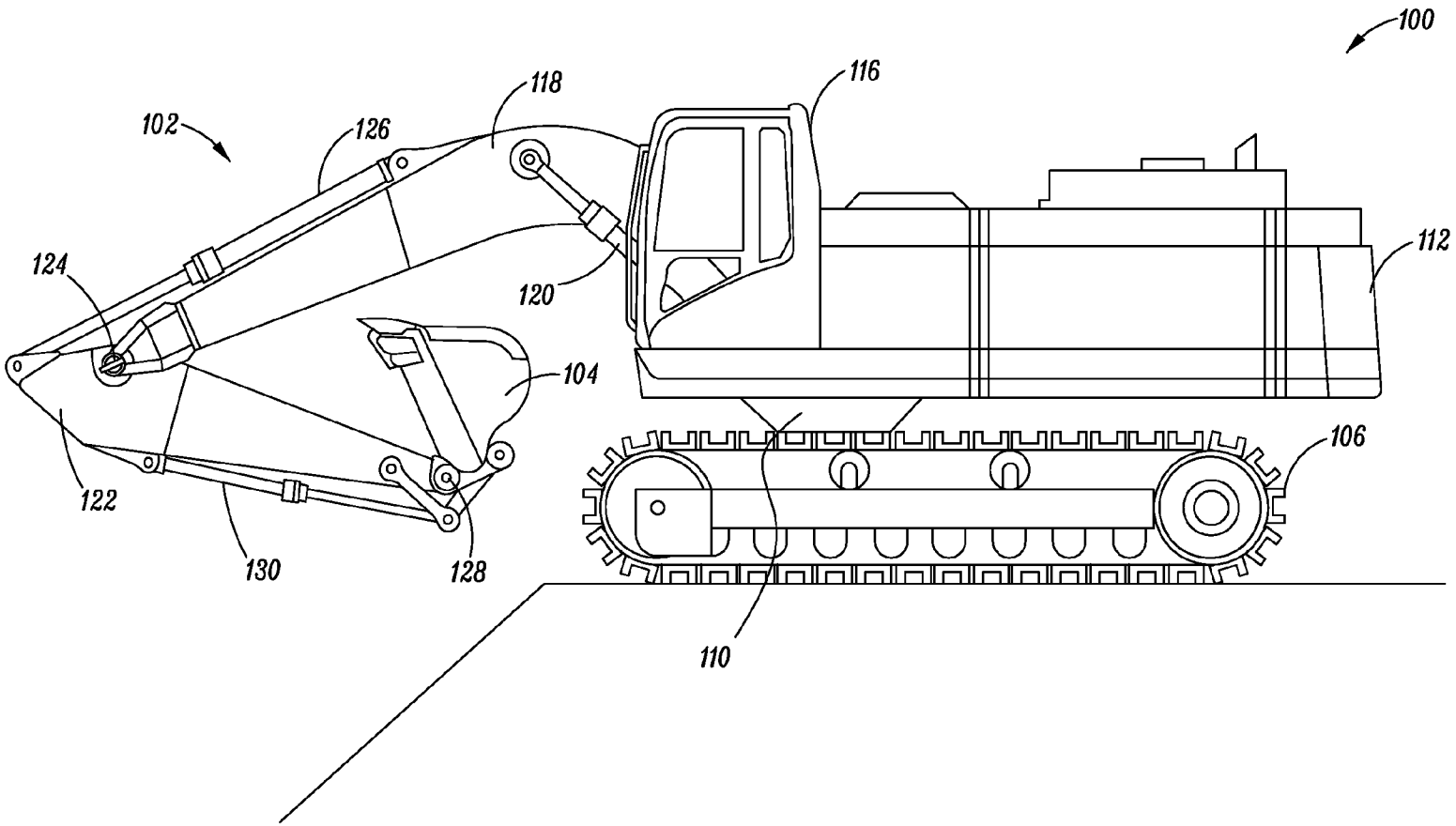
FIG. 1 illustrates a side view of a machine, according to an embodiment of the present disclosure.

Wherever possible, the same reference numbers will be used throughout the drawings to refer to the same or the like parts. FIG. 1 illustrates a side view of a machine 100. The machine 100 may include an on-highway vehicle or an off-highway vehicle. Further, the machine 100 may include any machine that may be used for the purpose of construction, mining, quarrying, and so on. In the embodiment of FIG. 1, the machine 100 is a hydraulic mining shovel. The machine 100 may include an implement system 102 for performing various earth moving operations, such as digging, leveling, etc., through an implement 104. The machine 100 may further include a ground engaging member 106 that may be drivably coupled to a drive system (not shown) of the machine 100. In the embodiment of FIG. 1, the ground engaging member 106 may be a pair of tracks. However, it may be contemplated that the ground engaging member 106 may be a plurality of wheels. The ground engaging member 106 may be disposed on a base 110 of the machine 100.

The machine 100 may further include a frame 112 rotatably supported on the base 110 of the machine 100. The drive system may be disposed in the frame 112. The drive system may include a power source that may be configured to supply power to the implement system 102 and the ground engaging member 106. The power source may include an engine such as a diesel engine, a gasoline engine, a gaseous fuel engine, or any other type of combustion engine known in the art. It may also be contemplated that the power source may include electrical power sources such as a fuel cell, battery, and the like. The machine 100 may further include an operator cab 116 that may be disposed on the frame 112 of the machine 100. The operator cab 116 may include one or more operator interface devices configured to receive input from an operator. The input may be indicative of a desired operation of the implement system 102 and/or the machine 100. The operator interface devices may also provide information to the operator about various parameters of the machine 100. The operator interface devices may include levers, knobs, switches, pedals, touch screens, displays and any other operator interface devices known in the art.

As illustrated in FIG. 1, the implement system 102 may include a boom member 118 pivotally connected to the frame 112 of the machine 100. The boom member 118 may be pivotally mounted on the frame 112 such that the boom member 118 may be raised and lowered in relation to a ground surface using a first hydraulic actuator 120. The first hydraulic actuator 120 may be operatively coupled between the frame 112 and the boom member 118. The implement system 102 may further include a stick member 122 pivotally connected to the boom member 118. The stick member 122 is configured to be pivoted about a pin member 124 by a second hydraulic actuator 126. The second hydraulic actuator 126 may be operatively coupled between the boom member 118 and the stick member 122. Further, the implement 104 may be pivotally connected to the stick member 122. The implement 104 is configured to be pivoted about a pin member 128 by a third hydraulic actuator 130. The third hydraulic actuator 130 may be operatively coupled between the stick member 122 and the implement 104. In the illustrated embodiment, the implement 104 is a bucket. In an exemplary embodiment, each of the first, second and third hydraulic actuators 120, 126, 130 may be a double acting cylinder. Each of the hydraulic actuators 120, 126, 130 may include a cylinder and a piston rod slidably disposed within the cylinder to move the hydraulic actuators 120, 126, 130 between an extended position and a retracted position.

Figure 2:
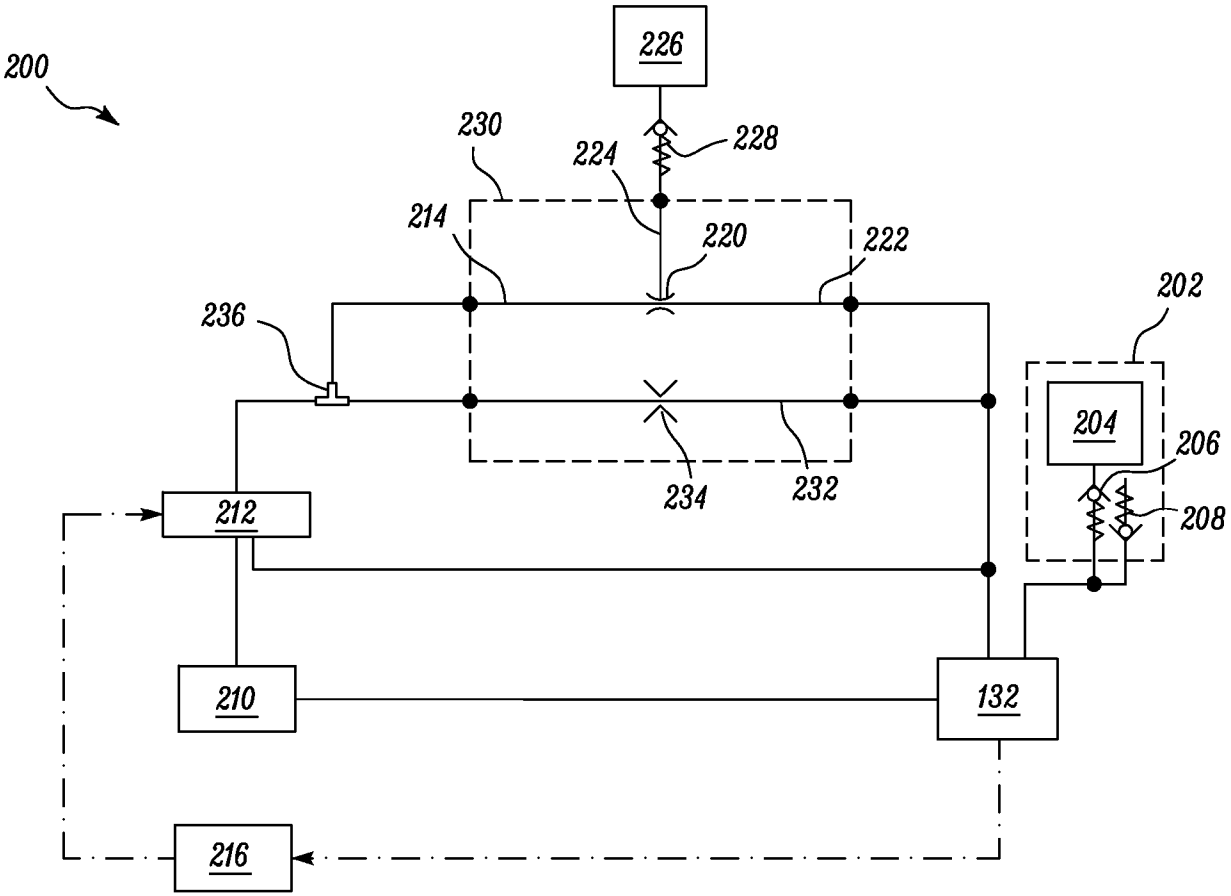
FIG. 2 illustrates a schematic diagram of a hydraulic system of the machine, according to an embodiment of the present disclosure.

The drive system of the machine 100 may further include a hydraulic system 200 (shown in FIG. 2). The hydraulic system 200 may include a hydraulic tank 132. The hydraulic tank 132 may be configured to store a liquid therein. In an embodiment, the liquid may include hydraulic oil or any other liquid known in the art. The liquid may be supplied to the implement system 102 and various other systems such as a steering system, a brake system, and other hydraulic systems of the machine 100. The hydraulic tank 132 may be located inside the frame 112 of the machine 100. The hydraulic tank 132 may be fluidly coupled to the first, second and third hydraulic actuators 120, 126, 130. The cylinder of each of the hydraulic actuators 120, 126, 130 may define a head end and a rod end. The head end and rod end of the cylinders may be fluidly coupled to the hydraulic tank 132 via one or more valves and pumps to selectively receive pressurized fluid form the hydraulic tank 132. The hydraulic actuators 120, 126, 130 may actuate the boom member 118, the stick member 122 and the implement 104 upon receiving the pressurized fluid. When the liquid from the hydraulic tank 132 is received in the cylinders through the head end thereof, the liquid present in the rod end of the cylinders may flow to the hydraulic tank 132 and thereby cause the hydraulic actuators 120, 126, 130 to move to the extended position thereof. Similarly, when the liquid from the hydraulic tank 132 is received in the cylinders through the rod end thereof, the liquid present in the head end of the cylinders may flow to the hydraulic tank 132 and thereby cause the hydraulic actuators 120, 126, 130 to move to the retracted position thereof.

FIG. 2 illustrates a hydraulic system 200 of the machine 100, according to an embodiment of the present disclosure. The hydraulic system 200 may include the hydraulic tank 132 configured to store a variable volume of the liquid. Further, the hydraulic tank 132 may be configured to receive a gaseous fluid therein. The gaseous fluid may be received within the hydraulic tank 132 and stored therein at a predetermined pressure. The predetermined pressure of the gaseous fluid may correspond to a pressure at which the liquid may be stored in the hydraulic tank 132. Thus, the liquid stored in the hydraulic tank 132 is being pressurized to be supplied to the implement system 102 and various other hydraulic systems of the machine 100. In the illustrated embodiment of FIG. 2, the gaseous fluid may be ambient air. In various other embodiments, the gaseous fluid may be an inert gas such as nitrogen, helium, and the like. Generally, a level of the liquid may be kept below a full capacity of the hydraulic tank 132 such that a top wall of the hydraulic tank 132 and an upper surface of the liquid may define an air space therebetween.

The hydraulic system 200 may further include a breather unit 202 mounted on the top wall of the hydraulic tank 132. During operation of the machine 100, a volume of the liquid may vary due to drainage and filling of the hydraulic tank 132. Consequently, a pressure within the hydraulic tank 132 may also vary. The breather unit 202 may include a first filter 204 configured to filter particulate matter from ambient air before ambient air is introduced within the hydraulic tank 132. A desiccant material may also be provided to absorb moisture from ambient air. The first filter 204 may be fluidly coupled to the top wall of the hydraulic tank 132 via a check valve 206. The check valve 206 may be configured to allow unidirectional flow of ambient air from the first filter 204 to the hydraulic tank 132. Ambient air may enter the hydraulic tank 132 when a pressure within the hydraulic tank 132 decreases due to drainage of the liquid. The breather unit 202 may further include a relief valve 208 that may be in fluid communication with the hydraulic tank 132. The relief valve 208 may be configured to release pressure from the hydraulic tank 132 to atmosphere if a pressure within the hydraulic tank 132 increases beyond the predetermined pressure during filling.

The hydraulic system 200 further includes a pump 210 that may define a closed loop circuit with the hydraulic tank 132. In the closed loop circuit, the pump 210 may be fluidly connected with the hydraulic tank 132 to receive the liquid therefrom and supply the liquid back to the hydraulic tank 132. In an embodiment, the pump 210 may be a positive displacement pump of any well known construction and type, such as, a gear pump, a rotary pump, an axial piston pump, a radial piston pump and the like. In an alternative embodiment, the pump 210 may be a fixed displacement hydraulic pump. The pump 210 may be located within the frame 112 of the machine 100 and may be drivably coupled to the power source. The pump 210 may be coupled to the power source by, for example, but not limited to, a gear drive, a belt drive, a chain drive, or any other drive known in the art. In an exemplary embodiment, the pump 210 may include a movable swash plate that may be adjusted to vary a displacement of the liquid. The swash plate may be adjusted based on an input via, for example, hydraulic pilot, pneumatic pilot, electric signal, or any other method known in the art. Upon actuation of the pump 210, the pump 210 starts receiving the liquid from the hydraulic tank 132 and subsequently, supplies the liquid to a valve 212.

The valve 212 may be fluidly coupled to the pump 210 to receive the liquid supplied from the pump 210 and selectively allow the liquid to flow to a first conduit 214. In an exemplary embodiment, the valve 212 may be a three-way valve movable between a first position and a second position. As shown in FIG. 2, an inlet port of the valve 212 may be in fluid communication with the pump 210. Further, an outlet port and an exhaust port of the valve 212 may be in fluid communication with the first conduit 214 and the hydraulic tank 132, respectively. The valve 212 may further include a valve body that may be configured to cause movement of the valve 212 between the first position and the second position. The first position of the valve 212 may allow the liquid received from the pump 210 to flow to the first conduit 214, and the second position of the valve 212 may allow the liquid to flow back to the hydraulic tank 132. Although the valve 212 is a three-way two position valve, it may be contemplated that the valve 212 may be any directional control valve known in the art. In one example, the valve 212 may include a solenoid (not shown) such that the valve body of the valve 212 may be electrically actuated upon receipt of a control signal from a controller 216. The controller 216 may be in electric communication with the hydraulic tank 132 to monitor a pressure of the gaseous fluid within the hydraulic tank 132. The controller 216 may be further communicated with the valve 212 to send a control signal based on the pressure of the gaseous fluid within the hydraulic tank 132. Upon receipt of the control signal from the controller 216, the solenoid may actuate the valve 212 to move from the second position and the first position. The valve body may be in the second position when a pressure in the hydraulic tank 132 is equal to or greater than the predetermined pressure. Although the valve body of the valve 212 is actuated electrically, it may be contemplated that the valve 212 may be actuated mechanically, pneumatically, hydraulically or by any other method known in the art.

In an embodiment, the controller 216 may include a single microprocessor or multiple microprocessors that may be configured with other associated components to control various functions of the hydraulic system 200. The controller 216 may also be configured to control various other components of the machine 100, for example, the power source. The controller 216 may further be connected to an operator interface that may include various control members such as, but not limited to, buttons, levers, joysticks, and pedals, to allow an operator to give desired input to the controller 216.

The first conduit 214 of the hydraulic system 200 may be in fluid communication with a venturi 220. The venturi 220 may further be in fluid communication with a second conduit 222. The second conduit 222 may also be in fluid communication with the hydraulic tank 132. The venturi 220 may be fluidly coupled to a fluid conduit 224. The fluid conduit 224 may further be in fluid communication with a second filter 226. The second filter 226 may be in fluid communication with a source of a gaseous fluid. The second filter 226 may be further configured to filter solid particles and moisture from the gaseous fluid as the gaseous fluid passes through the second filter 226. A check valve 228 may be disposed between the fluid conduit 224 and the second filter 226 to allow a unidirectional flow of the gaseous fluid from the second filter 226 to the fluid conduit 224. The fluid conduit 224 supplies the venturi 220 with the gaseous fluid. In the embodiment of FIG. 2, the fluid conduit 224 may receive ambient air from the second filter 226. If the gaseous fluid is inert gas, then the hydraulic system 200 may include an inert gas reservoir to store the inert gas. The inert gas reservoir may be fluidly coupled to the fluid conduit 224 to receive the inert gas therefrom. Alternatively, the inert gas may be communicated to the fluid conduit 224 through the second filter 226. Additionally, a control valve (not shown) may be fluidly disposed between the fluid conduit 224 and the inert gas reservoir to selectively communicate the inert gas with the fluid conduit 224.

In an embodiment, the first conduit 214, the venturi 220, the second conduit 222 and the fluid conduit 224 may be provided in a housing member 230. An additional conduit 232 may be provided in the housing member 230 parallel to the first conduit 214. Further, an orifice 234 may be defined in the additional conduit 232 to restrict flow of the liquid received in the additional conduit 232. The first conduit 214 and the additional conduit 232 may be fluidly coupled to the valve 212 via a connector 236. The connector 236 may split a flow 'F' of the liquid received from the valve 212 into a first flow 'F1' and a second flow 'F2'. The first flow 'F1' and the second flow 'F2' may be routed to the first conduit 214 and the additional conduit 232, respectively. The additional conduit 232 may be in fluid communication with the hydraulic tank 132. In an embodiment, the connector 236 may be a T-connector with a single intake fluidly connected to the valve 212 and two outlets fluidly connected to the first conduit 214 and the additional conduit 232, respectively.

Figure 3:
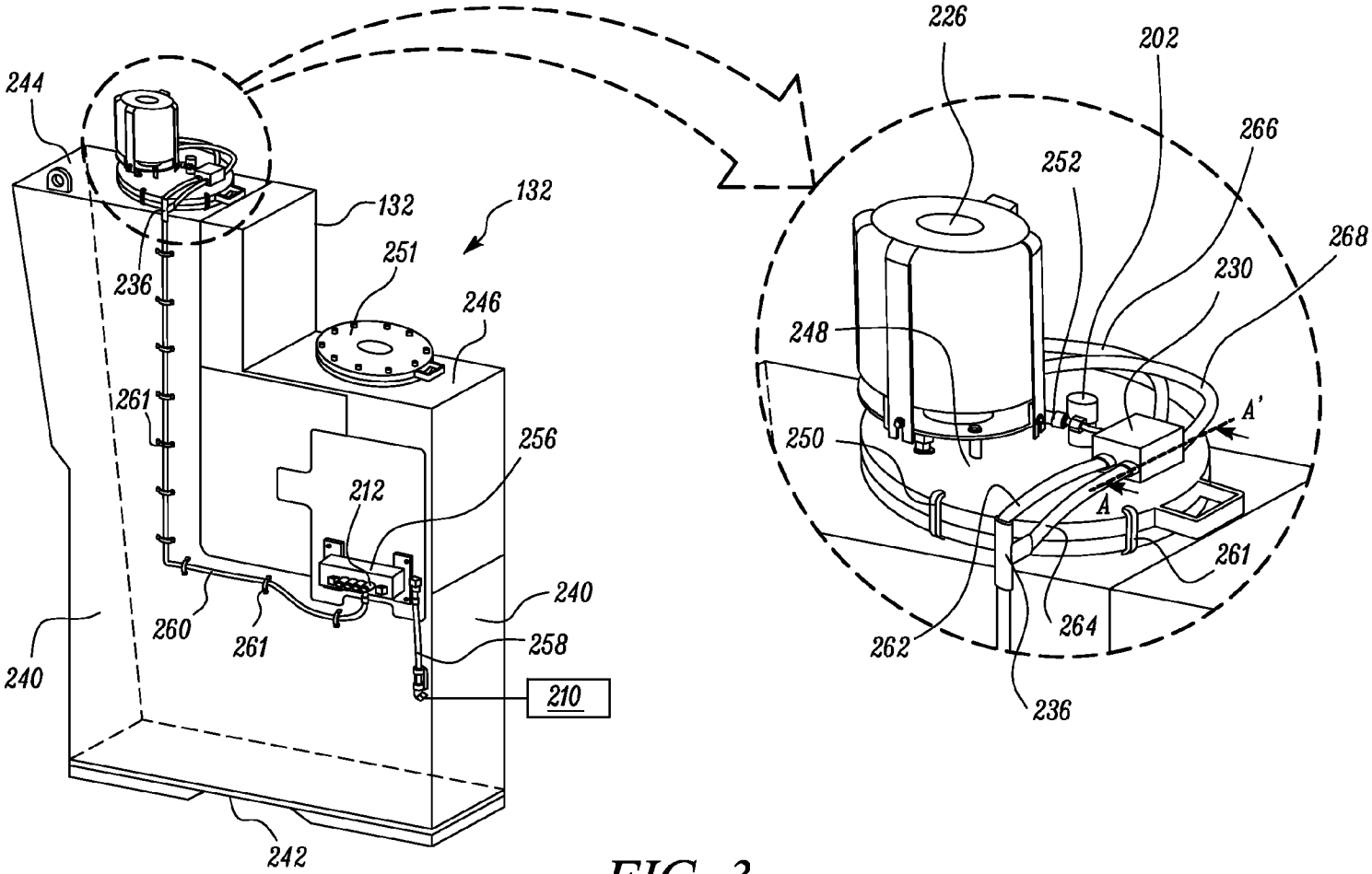
FIG. 3 illustrates a perspective view of a hydraulic tank associated with the hydraulic system of FIG. 2, according to an embodiment of the present disclosure.

FIG. 3 shows a perspective view of the hydraulic tank 132, according to an embodiment of the present disclosure. The hydraulic tank 132 may include multiple side walls 240 and a bottom wall 242 which are in substantially fluid tight connection with each other. Further, the hydraulic tank 132 may include a first top wall 244 and a second top wall 246. The first top wall 244, the second top wall 246, side walls 240 and the bottom wall 242 together may define a closed container to store the liquid therein and pressurize the liquid by receiving the gaseous fluid therein. The first top wall 244 may be provided with an opening (not shown). A plate 248 may be removably mounted on the first top wall 244 to close the opening. In the illustrated embodiment, the plate 248 may be mounted on the first top wall 244 via fasteners 250. The fasteners 250 may be bolts, screws, or any other fasteners known in the art. The second filter 226 may be removably mounted on the plate 248. A liquid filling opening may be provided in the second top wall 246. The opening may be closed by a cap 251. A fluid pipe 252 may be coupled between the second filter 226 and the fluid conduit 224 (shown in FIG. 2) of the housing member 230. The housing member 230 may also be removably mounted on the plate 248 via fastening members such as, but not limited to, bolt or stud. The breather unit 202 may also be removably disposed on the plate 248. The breather unit 202 may be in communication with the air space (not shown) adjacent to the first top wall 244 of the hydraulic tank 132. The second filter 226, breather unit 202 and the housing member 230 may be mounted on the plate 248 to facilitate easy dismantling and serviceability thereof.

The valve 212 may be removably disposed on a valve support 256. The valve support 256 may be removably mounted on one of the side walls 240. In addition, the valve 212, various other valves associated with other systems of the machine 100, such as the implement system 102, steering system, etc., may also be disposed in the valve support 256. A liquid line 258 may be coupled between the valve 212 and the pump 210. The pump 210 may supply the liquid from the hydraulic tank 132 to the valve 212 through the liquid line 258. The valve 212 may selectively allow the liquid to flow to the housing member 230 through a liquid line 260. The liquid lines 258 and 260 may be positioned on the surface of the side wall 240 via a plurality of clamping member 261. The connector 236 may be fluidly disposed in the liquid line 260 to branch the liquid line 260 into a first inlet line 262 and a second inlet line 264. The first inlet line 262 may be fluidly connected to the first conduit 214 and the second inlet line 264 may be fluidly connected to the additional conduit 232 of the housing member 230. The second conduit 222 and the additional conduit 232 may be further fluidly connected to a first outlet line 266 and a second outlet line 268, respectively, to supply the liquid to the hydraulic tank 132. In various embodiments, the liquid lines 258, 260, the first and second inlet lines 262, 264 and the first and second outlet lines 266, 268 may be pipes, hoses, or any other liquid carrying members known in the art.

Figure 4:
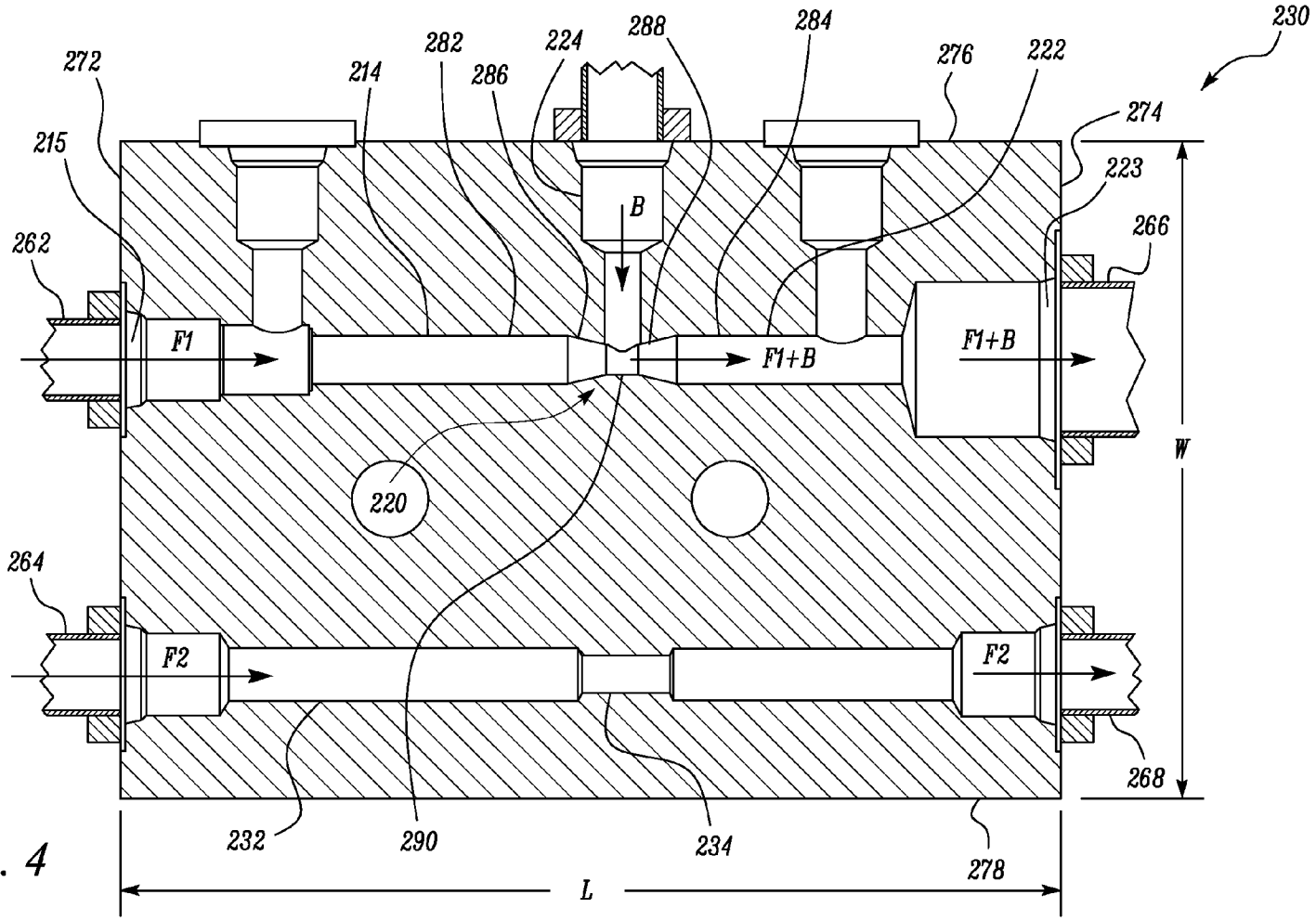
FIG. 4 illustrates a sectional view of a housing member taken along line A-A' of FIG. 3.

FIG. 4 shows a sectional view of the housing member 230 of FIG. 3. The housing member 230 may be a substantially rectangular body defining a length 'L' between a first end 272 and a second end 274, and a width 'W' between a third end 276 and a fourth end 278. Further, the housing member 230 may also define a uniform thickness (not shown) along the length 'L' of the body of the housing member 230. The first conduit 214 may be open at the first end 272 of the housing member 230 and extends towards the second end 274. The second conduit 222 may be opened at the second end 274 and extend towards the first end 272. The first conduit 214 may be integrated with an inlet 282 of the venturi 220. An outlet 284 of the venturi 220 may be integrated with the second conduit 222. A port 215 may be provided at opening of the first conduit 214 adjacent to the first end 272 to couple with the first inlet line 262. Similarly, a port 223 may be provided at opening of the second conduit 222 adjacent to the second end 274 to couple with the first outlet line 266. In an embodiment, the first inlet line 262 and the first outlet line 266 may be detachably coupled to the ports 215 and 223, respectively, by any coupling methods known in the art, for example, of quick coupling, threaded engagement, and the like.

The venturi 220 may include a converging portion 286, a diverging portion 288 and a throat 290. The throat 290 may extend between the converging portion 286 and the diverging portion 288. The converging portion 286 may have a cross-sectional area which progressively decreases from the inlet 282 to the throat 290. The diverging portion 288 may have a cross-sectional area which progressively increases from the throat 290 to the outlet 284. The throat 290 may have a uniform cross-sectional area between the converging portion 286 and the diverging portion 288. The first conduit 214, the second conduit 222 and the venturi 220 may be aligned axially along the length 'L' of the housing member 230. The fluid conduit 224 may be opened at the third end 276 and extends towards the venturi 220. Further, the fluid conduit 224 may be integrated with the throat 290 of the venturi 220.

The housing member 230 may further include the additional conduit 232 extending along the length 'L' parallel to the first conduit 214. Further, the additional conduit 232 may be open at the first end 272 and the second end 274 of the housing member 230. The orifice 234 may be formed substantially at a center of the additional conduit 232.

Figure 5:
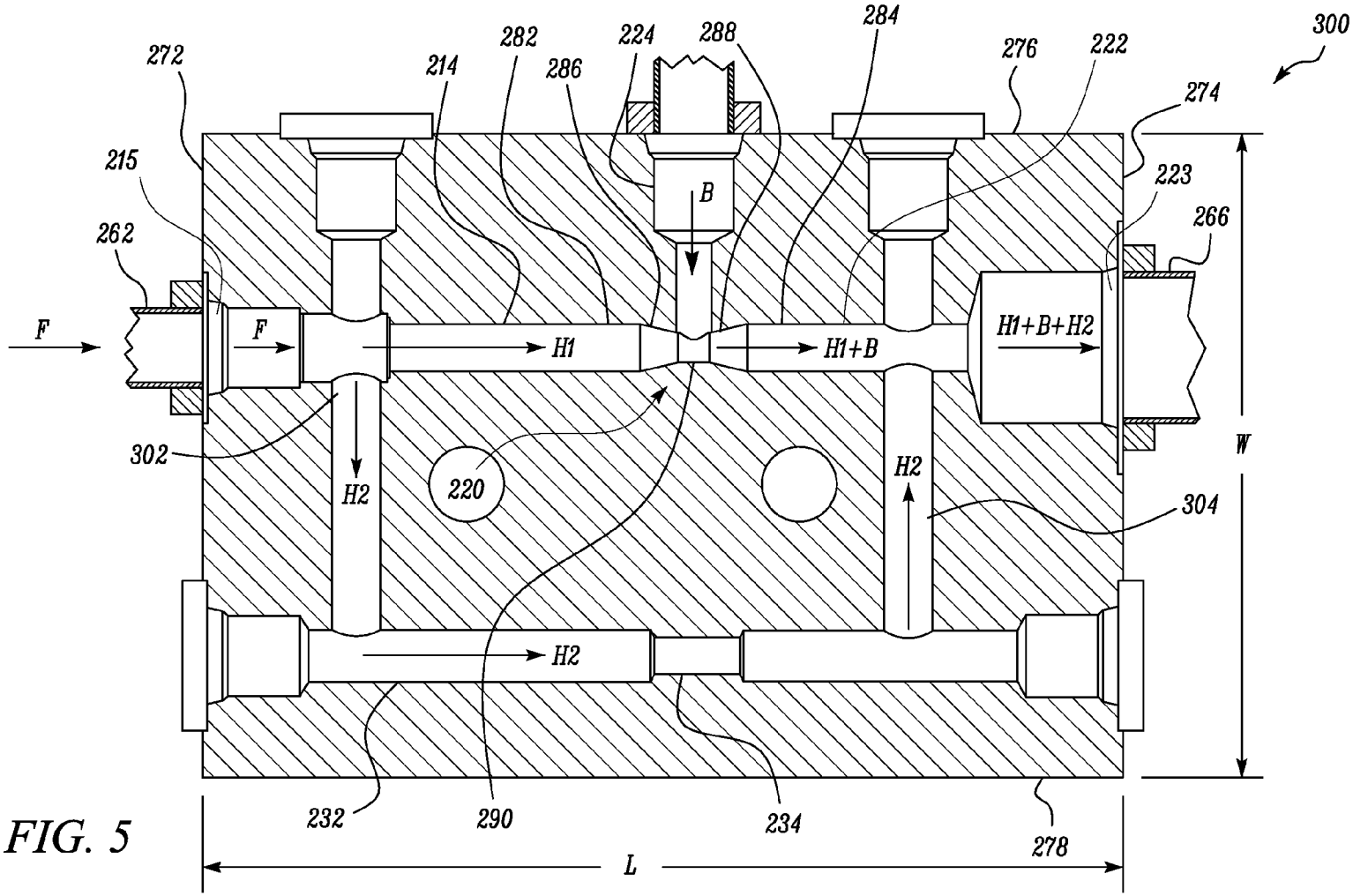
FIG. 5 illustrates a sectional view of the housing member, according to another embodiment of the present disclosure.
Figure 6:
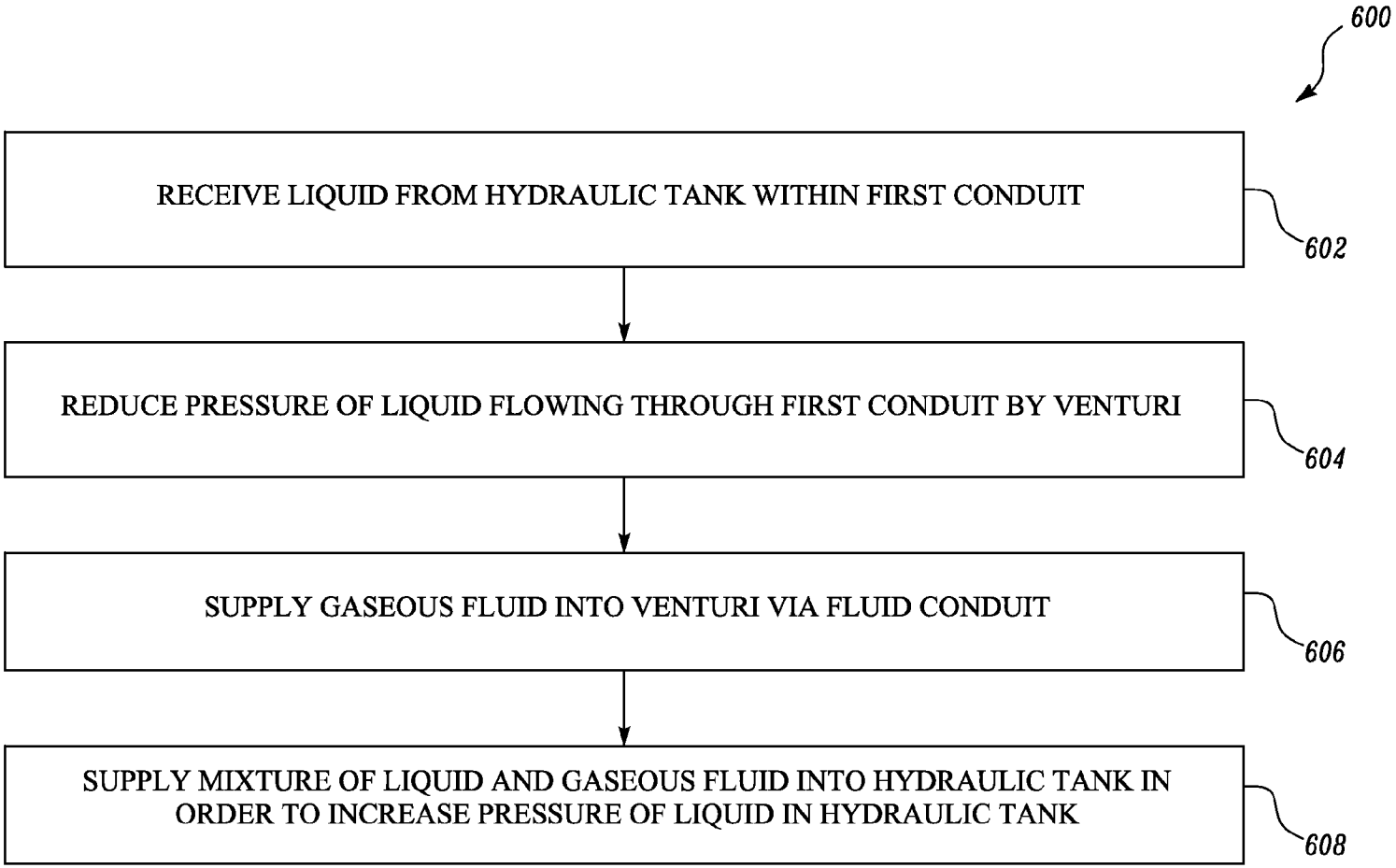
FIG. 6 illustrates a flowchart of a method for controlling the hydraulic system, according to an embodiment of the present disclosure.

FIG. 5 illustrates a sectional view of a housing member 300, according to another embodiment of the present disclosure. The housing member 300 may include a first passage 302 fluidly disposed between the first conduit 214 and the additional conduit 232. Further the first passage 302 may extend substantially perpendicular to the first conduit 214 and open at the third end 276. Similarly, the housing member 300 may include a second passage 304 fluidly disposed between the second conduit 222 and the additional conduit 232. The second passage 304 may extend substantially perpendicular to the second conduit 222 and open at the third end 276. The openings of the additional conduit 232 at the first end 272 and the second end 274 may be optionally closed using a cap or a plug. Similarly, openings of the first passage 302 and the second passage 304 at the third end 276 of the housing member 300 may also be closed using a cap or plug.

The connector 236 may not be provided in the liquid line 260 (shown in FIG. 3), and the flow 'F' of the liquid from the valve 212 (shown in FIG. 3) may be received in the first conduit 214. A portion of the flow 'F' may then flow through the first passage 302. A remainder of the flow 'F' may pass through the first conduit 214 and the venturi 220. As shown in FIG. 5, the flow 'F' is split into a first flow 'II1' through the first conduit 214 and a second flow 'II2' through the first passage 302, respectively. A ratio between volumes of the flows 'H1' and 'H2' may be determined by a ratio between cross-sectional areas of the first conduit 214 and the first passage 302. Further, the flow 'II2' may pass through the orifice 234 disposed in the additional conduit 232 and subsequently passes through the second passage 304 to the second conduit 222.

INDUSTRIAL APPLICABILITY

A machine includes one or more hydraulic actuators to carry out various functions. One or more pumps supply the hydraulic actuators with pressurized hydraulic fluid for actuation. The pumps are connected to a hydraulic tank which stores the hydraulic fluid. The hydraulic fluid may be maintained at an elevated pressure within the hydraulic tank in order to meet the inlet fluid characteristic requirements of the pumps.

The present disclosure relates to the hydraulic system 200 of the machine 100 and a method 600 for controlling the hydraulic system 200 to pressurize the liquid stored in the hydraulic tank 132. At step 602, the method 600, includes receiving the liquid from the hydraulic tank 132 within the first conduit 214. The pump 210 communicated to the hydraulic tank 132 may receive the liquid stored therein upon actuation of the pump 210 through the drive system. The pump 210 may supply the liquid to the valve 212. The valve 212 may be in continuous communication with the hydraulic tank 132 through the controller 216 to receive a control signal based on the predetermined pressure of the gaseous fluid within the hydraulic tank 132. If the controller 216 sends a control signal corresponding to a pressure that is equal to, or greater than the predetermined pressure of the gaseous fluid, the valve 212 may remain in the second position. In the second position, the liquid received by the pump 210 may be allowed to flow back to the hydraulic tank 132 through the valve 212. Alternatively, if the controller 216 sends a control signal corresponding to a pressure that is less than the predetermined pressure of the gaseous fluid, the controller 216 may actuate the valve body such that the valve 212 may move to the first position. In the first position, the liquid received from the pump 210 may be routed to the first conduit 214.

In an embodiment, a portion of the liquid supplied from the valve 212 may also be supplied to the additional conduit 232 of the housing member 230. The connector 236 disposed between the valve 212 and the first conduit 214 may split the flow 'F' of the liquid into the first flow 'F1' and the second flow 'F2', and supply to the first conduit 214 and the additional conduit 232, respectively. In another embodiment, the pressurized liquid may be selectively supplied from the valve 212 to the first conduit 214 of the housing member 300. From the first conduit 214, the second flow 'H2' of the liquid may pass through the first passage 302 and subsequently pass through the orifice 234. The orifice 234 may provide a restriction to the second flows 'F2', 'H2'. The restriction provided by the orifice 234 may increase a temperature of the liquid flowing therethrough. Increase in temperature may cause heating of the housing members 230, 300 and avoid freezing of condensed water during cold weather conditions. Thus, the housing member 230, 300 may not require any external heating as the additional conduit 232 may use the second flows 'F2', 'H2' therethrough to provide required heating.

At step 604, the method 600 further includes reducing pressure of the liquid that flows through the first conduit 214. As the liquid flows through the converging portion 286 of the venturi 220 from the first conduit 214, a flow velocity of the liquid may increase due to a decrease in a cross-sectional area of converging portion 286. Consequently, a pressure of the liquid decreases. Specifically, the pressure at the throat 290 of the venturi 220 may become lower than atmospheric pressure.

At step 606, the method 600, includes supplying the gaseous fluid into the venturi 220 via the fluid conduit 224. Due to lower pressure of the liquid at the throat 290 relative to atmospheric pressure, gaseous fluid may be received to the fluid conduit 224 through the second filter 226. The second filter 226 may filter gaseous fluid to remove particulate matter and also absorb moisture. A pressure difference between the throat 290 of the venturi 220 and atmosphere may enable a flow 'B' of the gaseous fluid through the check valve 228 to the throat 290 of the venturi 220. At the throat 290 of the venturi 220, the flow 'B' of the gaseous fluid may mix with the first flows 'F1' or 'H1' of the liquid. Thus, the pressure difference between the throat 290 of the venturi 220 and atmosphere may cause gaseous fluid to be received in the throat 290. The pressure of the liquid may increase while flowing through the diverging portion 288 due to an increase in a cross-sectional area.

A pressure of the liquid at the throat 290 may be determined based on including, but not limited to, a pressure at which the liquid may be supplied by the pump 210 to the valve 212, cross-sectional area of the first conduit 214, variation in cross-sectional area of the converging portion 286, and the like. Further, various parameters of the venturi 220, for example, lengths of the converging portion 286, the throat 290, the diverging portion 288, and variations in cross-sectional areas of the converging portion 286 and the diverging portion 288, etc., may be selected based on a required decrease in pressure of the liquid flowing through the venturi 220.

At step 608, the method 600 includes supplying the mixture of gaseous fluid and the liquid into the hydraulic tank 132. The flow 'B' of the gaseous fluid and the first flows 'F1' or 'H1' may pass through the diverging portion 288 of the venturi 220 and then through the second conduit 222 and the first outlet line 266 to the hydraulic tank 132. Thus, based on a pressure within the hydraulic tank 132, additional gaseous fluid may be received in the hydraulic tank 132 and pressurize the liquid stored therein. The second flows 'F2', 'H2', through the additional conduit 232, may also be supplied back to the hydraulic tank 132. The gaseous fluid received through the first filter 204 of the breather unit 202 and additional gaseous fluid received through the second filter 226 may together cause pressurization within the hydraulic tank 132. Further, extent of pressurization may be controlled by regulating the pump 210 and the valve 212.

The hydraulic system 200 may therefore achieve pressurization of the hydraulic tank 132 without requiring any additional powered device, such as a compressor. The venturi 220 may require minimal maintenance and provide a consistent operation due to absence of any moving components.

Further, in case of the housing member 300, separate inlet and outlet lines may not be required for the additional conduit 232. The first conduit 214 may receive the flow 'F' from the valve 212. Further, the first outlet line 266 may transport the mixture of the liquid and the gaseous fluid from the first conduit 214, along with the second flow 'H2' from the additional conduit 232 to the hydraulic tank 132. Thus, the first and second passages 302, 304 may therefore enable splitting and merging of various flows of the liquid within the housing member 300 without requiring additional connectors and pipes.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A hydraulic system for a machine, the hydraulic system comprising:

a hydraulic tank configured to store a liquid therein;

a first conduit in fluid communication with the hydraulic tank, the first conduit configured to receive the liquid from the hydraulic tank;

a venturi in fluid communication with the first conduit, the venturi configured to reduce a pressure of the liquid flowing therethrough;

a fluid conduit in fluid communication with the venturi, the fluid conduit configured to supply a gaseous fluid into the venturi;

a second conduit in fluid communication with the venturi, the second conduit configured to supply a mixture of the liquid and the gaseous fluid into the hydraulic tank in order to increase a pressure of the liquid in the hydraulic tank;

a connector configured to split a flow of the liquid from the hydraulic tank into a first liquid flow supplied to the first conduit and a second liquid flow supplied to an additional conduit, wherein the additional conduit is defined in a housing member to receive the second liquid flow therein, the additional conduit comprises an orifice to provide a restriction to the liquid flowing through the additional conduit.

2. The hydraulic system of claim 1, wherein the venturi comprising:

a converging portion in fluid communication with the first conduit;

a diverging portion in fluid communication with the second conduit; and a throat portion disposed between the converging portion and the diverging portion, wherein the throat portion is in fluid communication with the fluid conduit.

3. The hydraulic system of claim 1 further comprising a valve configured to selectively supply the liquid from the hydraulic tank to the first conduit.

4. The hydraulic system of claim 3 further comprising a pump fluidly disposed between the hydraulic tank and the valve, the pump configured to supply the liquid to the first conduit.

5. The hydraulic system of claim 1 further comprising a filter in fluid communication with the fluid conduit, the second filter configured to filter the gaseous fluid received therein.

6. The hydraulic system of claim 1, wherein the gaseous fluid is air.

7. The hydraulic system of claim 1 further comprising a breather unit fluidly disposed on the hydraulic tank, the breather unit configured to maintain a predetermined pressure within the hydraulic tank.

8. The hydraulic system of claim 7, wherein the breather unit comprising:

a check valve configured to allow a unidirectional flow of the gaseous fluid into the hydraulic tank; and a relief valve configured to selectively release the gaseous fluid from the hydraulic tank to atmosphere.

9. The hydraulic system of claim 1 further comprising a housing member, the housing member including:

the first conduit fluidly coupled to the hydraulic tank to receive the liquid therein;

the second conduit configured to fluidly couple to the hydraulic tank to supply the mixture of air and the liquid to the hydraulic tank; and the venturi defined between the first conduit and the second conduit to reduce pressure of the liquid flowing therethrough.

10. A machine comprising:

a frame;

a hydraulic tank mounted on the frame, the hydraulic tank configured to store a liquid therein; and a hydraulic system in fluid communication with the hydraulic tank, the hydraulic system comprising:

a first conduit in fluid communication with the hydraulic tank configured to receive the liquid from the hydraulic tank;

a venturi in fluid communication with the first conduit, the venturi configured to reduce a pressure of the liquid flowing therethrough;

a fluid conduit in fluid communication with the venturi, the fluid conduit configured to supply a gaseous fluid into the venturi;

a second conduit in fluid communication with the venturi, the second conduit configured to supply a mixture of the liquid and the gaseous fluid into the hydraulic tank in order to increase a pressure of the liquid in the hydraulic tank; and a connector configured to split a flow of the liquid from the hydraulic tank into a first liquid flow supplied to the first conduit and a second liquid flow supplied to an additional conduit, wherein the additional conduit is defined in a housing member to receive the second liquid flow therein, the additional conduit comprises an orifice to provide a restriction to the liquid flowing through the additional conduit.

11. The machine of claim 10, wherein the venturi comprising:

a converging portion in fluid communication with the first conduit;

a diverging portion in fluid communication with the second conduit; and a throat portion disposed between the converging portion and the diverging portion, wherein the throat portion is in fluid communication with the fluid conduit.

12. The machine of claim 10, further comprising a valve configured to selectively supply the liquid from the hydraulic tank to the first conduit.

13. The machine of claim 12, further comprising a pump fluidly disposed between the hydraulic tank and the valve, the pump configured to supply the liquid to the first conduit.

14. The machine of claim 10, further comprising a breather unit fluidly disposed on the hydraulic tank, the breather unit configured to maintain a predetermined pressure within the hydraulic tank.

15. The machine of claim 14, wherein the breather unit comprising:

a check valve configured to allow a unidirectional flow of the gaseous fluid into the hydraulic tank; and a relief valve configured to selectively release the gaseous fluid from the hydraulic tank to atmosphere.

16. A method of controlling a hydraulic system comprising:

receiving a liquid from a hydraulic tank within a first conduit;

reducing pressure of the liquid flowing through the first conduit by a venturi;

supplying a gaseous fluid into the venturi via a fluid conduit;

supplying a mixture of the liquid and the gaseous fluid into the hydraulic tank in order to increase a pressure of the liquid in the hydraulic tank; and splitting the flow of the liquid from the valve into a first liquid flow supplied to the first conduit and a second liquid flow supplied to an additional conduit, wherein the additional conduit is defined in a housing member to receive the second liquid flow therein and the additional conduit comprises an orifice to provide a restriction to the liquid flowing through the additional conduit.

17. The method of claim 16, further comprising selectively supplying the liquid to the first conduit through a valve based on a pressure within the hydraulic tank.

* * * * *